United States Patent [19]

Weidler

[11] Patent Number: 4,983,132

[45] Date of Patent: Jan. 8, 1991

[54] CONNECTOR FOR MATING BUS BARS

[75] Inventor: Charles H. Weidler, Lancaster, Pa.

[73] Assignee: AMP Incorporated, Harrisburg, Pa.

[21] Appl. No.: 451,471

[22] Filed: Dec. 15, 1989

[51] Int. Cl.[5] ..... H01R 11/09

[52] U.S. Cl. ..... 439/786; 439/251; 439/724; 439/805; 439/787

[58] Field of Search ..... 439/250, 251, 723, 724, 439/786, 787, 790, 794, 796, 805, 856

[56] References Cited

U.S. PATENT DOCUMENTS

| | | | |
|---|---|---|---|
| 3,086,190 | 4/1963 | Neidecker et al. | 439/787 |
| 4,453,792 | 6/1984 | Bright et al. | 439/251 |
| 4,462,657 | 7/1984 | Snowdon et al. | 439/724 |
| 4,660,920 | 4/1987 | Shibano | 439/724 |
| 4,684,191 | 8/1987 | Feher et al. | 439/246 |
| 4,845,589 | 7/1989 | Weidler et al. | 439/251 |
| 4,878,862 | 11/1989 | Wise | 439/787 |

FOREIGN PATENT DOCUMENTS

| | | | |
|---|---|---|---|
| 2263060 | 7/1974 | Fed. Rep. of Germany | 439/805 |
| 3630472 | 3/1988 | Fed. Rep. of Germany | 439/786 |
| 2594604 | 9/1987 | France | 439/787 |

*Primary Examiner*—Paula A. Bradley
*Attorney, Agent, or Firm*—Katherine A. Nelson

[57] ABSTRACT

An electrical connector (12) for mating two blade-shaped members (130, 150) includes a dielectric spacer member (14), first and second terminal elements (30, 60) secured to each of opposing major surfaces (16, 18) of spacer member (14), the first terminal element (30) being adjacent the spacer member (14) and the second terminal element (60) disposed outwardly of the first terminal element (30); and means (56) insulating associated first and second terminal elements (30, 60) from each other. Each first terminal element (30) includes a body section (32) having first and second arrays (44, 50) of cantilevered spring contact arms extending outwardly therefrom, defining first and second blade-receiving receptacles (48, 54) respectively therebetween. Each second terminal element (60) includes a body section (62) having third and fourth arrays (74, 80) of cantilevered spring contact arms extending outwardly therefrom. The third and fourth arrays (74,80) are associated with the first and second arrays (44,50) and extend the first and second receptacles (48, 54) respectively. Upon mating connector (10) with first and second blade-like members (130, 150), the contact arms of sets (86) of terminal elements (30, 60) engage a plurality of locations along respective sides (132, 152; 138, 158) of respective blade-like members (130, 150) thereby establishing a plurality of current paths therebetween.

7 Claims, 5 Drawing Sheets

10
91
104
102
96
106
174
174
110
98
12
82
88
60
80
74
84
52
31
48
54
52
76
50
26
24
30
44
46
78
61
74
100
102
106
112
108
110
96
94
92
104
112
98

CONNECTOR FOR MATING BUS BARS

FIELD OF THE INVENTION

This invention is related to the field of electrical connectors and more particularly to an electrical connector for interconnecting to blade-shaped members.

BACKGROUND OF THE INVENTION

In forming a power distribution system it is necessary to provide means for a hot line carrying power to the required load and a return line to the power source. In a typical power distribution system for an integrated circuit logic system as many as ten interconnections may be required. There are connections between power supply and bus bar, bus bar and a mother board, a mother board and the daughter board, and connections between the daughter board and socket in which chips are usually mounted and a connection between the socket and an actual integrated circuit. Thus there are five points of interconnection in the line going from the hot terminal to the load and another five points of interconnection complete the return line of the circuit. In many integrated circuit systems there can be no more than 250 millivolts of drop in the voltage at each load. Some logic systems furthermore require multiple voltage power distribution systems. These systems therefore require electrical connectors or contacts that will minimize voltage drops as the load is placed on the system.

The speed at which the systems are operated is continually being increased as technology advances. To accommodate the ever quickening rate of change in the current draw, power distribution systems were generally provided with capacitors mounted on the various boards to store current that would be readily available as the demands from the load change. This lumped element method presents problems in that there is insufficient space available to accommodate larger capacitors required for higher speed logic families or higher rates of change in current demand.

Power distribution systems are often designed to use a laminated bus-bar wherein the hot and return conductors are placed in close proximity separated by a thin insulative layer. One problem associated with laminated bus bars, however, is the inability to use standard two sided receptacle contacts to interconnect the laminated bus bar with another or to terminate to the laminated bus bar since a standard contact will electrically short the outer most conductive layers of the bus bar. Typically interconnections to laminated bus bars are made by providing the bus bar layers with tabs that extend outwardly from the various layers to which a wire or contact may be bolted to one voltage or layer. Since the wide bus bars are good conductors of heat as well as electricity, it is extremely difficult to achieve effective connections to the bus bar by soldering techniques. It is desirable to have a separately means for connecting to the laminated bus bar system that retains the "plugability" of the system.

Terminals such as those disclosed in U.S. Pat. Nos. 4,845,589 and 4,684,191 are receptacle terminals for providing severable interface for power interconnection to single layer bus bars. The terminals have opposing spring arms which together act as a flared receptacle to receive a bus bar therebetween. The bus bar engages contact sections of the spring arms and deflects the stiff spring arms outwardly thereby generating a sufficient contact normal force between the terminal and the bus bar. While the terminals described above are suitable for connecting to bus bars, the bus bars are ones that comprise a single unit carrying a single voltage. These terminals are unsuitable for use with laminated bus bars since they would provide an electrical connection or short between the outer conductive layers of the laminated bus bar.

U.S. Pat. No. 4,878,862 discloses an electrical connector for mating two blade-shaped members, each having opposed first and second sides. The connector comprises first and second terminal elements having body sections secured together with insulating means therebetween. Each first and second terminal element has a first and second arrays of spaced cantilevered spring contact arms extending outwardly from respective leading and trailing edges of the body section. The corresponding spring contact arms of the arrays of the terminal elements are interlaced proximate the leading and trailing edges, the spring contact arms of one terminal element extending into the spacing between contact arms of the other terminal element. The spring contact arms of the arrays define first and second blade-receiving receptacles. The free ends of the contact arms of the first and second arrays of the first terminal element are disposed along the second side of the first and second blade-receiving receptacles respectively and are adapted to be deflected outwardly by corresponding second sides of respective first and second mating blade-shaped members. The free ends of the spring contact arms of the first and second arrays of the second terminal element are disposed along the first side of the first and second blade-receiving receptacles respectively and are adapted to be deflected outwardly by corresponding first sides of respective first and second mating blade-shaped members. Since the respective contact arms of the terminal elements must pass through spaces between the contact arms of the other terminal element, the number of compliant spring arms and the proximity of the adjacent arms that can be accommodated in a given space is limited.

SUMMARY OF THE INVENTION

Accordingly, to alleviate the disadvantages and deficiencies of the prior art the present invention is directed to a connector and connector assembly that can carry high currents of two different voltages across an interface.

The electrical connector includes a dielectric spacer member having opposed major surfaces, a first terminal element and at least a second terminal element secured to each of opposing major surfaces of the spacer member for electrical interconnection of first and second electrical articles at leading and trailing edges respectively. The first terminal element is adjacent the spacer member and the second terminal element is disposed outwardly of the first terminal element. The first and second terminal elements are electrically insulated from each other. Each first terminal element includes a body section having first and second arrays of cantilevered spring contact arms extending outwardly from respective leading and trailing edges thereof. The contact arms of both the first and second arrays of the pair of opposed first terminal elements define first and second blade-receiving receptacles respectively therebetween.

Each second terminal element includes a body section having third and fourth arrays of cantilevered spring contact arms extending outwardly from respective leading and trailing edges thereof, the third arrays being proximate and associated with the first arrays, and the fourth arrays being proximate and associated with the second arrays. The contact arms of both the third and fourth arrays of the opposed second terminal elements are longer than the corresponding ones of the first and second arrays. The free ends of the third array contact arms are disposed substantially coplanar with those of the associated first array and are located axially outwardly therefrom, thereby extending the first blade-receiving receptacle. Similarly, the free ends of the fourth array contact arms are disposed substantially coplanar with those of the associated second arrays and are located axially outwardly therefrom, thereby extending the second blade-receiving receptacle.

Upon mating the connector with first and second blade-like members and outward deflection against spring bias of all the contact arms by the blade members, the first and third spring contact arm free ends engage the first blade member at a plurality of inner and outer locations along each respective first and second sides thereof and the second and fourth spring contact arm free ends engage the second blade member at a plurality of inner and outer locations along each respective first and second sides thereof. Each set of first and second terminal elements interconnects the corresponding first or second sides of the first and second blade members at a plurality of locations and forms a plurality of current paths thereacross. In the preferred embodiment each set of first and second terminal elements are insulated from each other thereby providing isolated sets of current paths.

The preferred embodiment of the invention further includes a housing means to hold the electrical connector terminal elements in position for mating to the blade-shaped members. The housing means is also used to mount the connector of the present invention in a desired location for mating to two bar shaped members. In accordance with the preferred embodiment the bar shaped members are laminated dual voltage bus bar members. In the presently preferred embodiment one side of the connector is secured to a bus bar that is for example used in a power supply module. Alternatively the connector housing can be mounted to a structure so that both connections with both bar-shaped members are separable.

It is the object of the present invention to provide a separable connection between a connector and at least one bar-shaped member, such as bus bar, circuit panel or the like, thus maintaining the plugability of the members into the connector.

More particularly it is an object of the invention to provide a separable connection between two laminated bus bars.

It is an additional object of the invention to provide a means whereby the resistance and the normal force required for effective interconnection across an interface can be lowered.

It is another object of the invention to provide a means for connecting members to and disconnecting members from a multivoltage power system.

The invention itself, together with further objects and its intended advantages, will be best understood by reference to the following detailed description taken in conjunction with the accompanying drawing.

DETAILED DESCRIPTION OF THE PREFERRED EMBODIMENT

Figure 1:
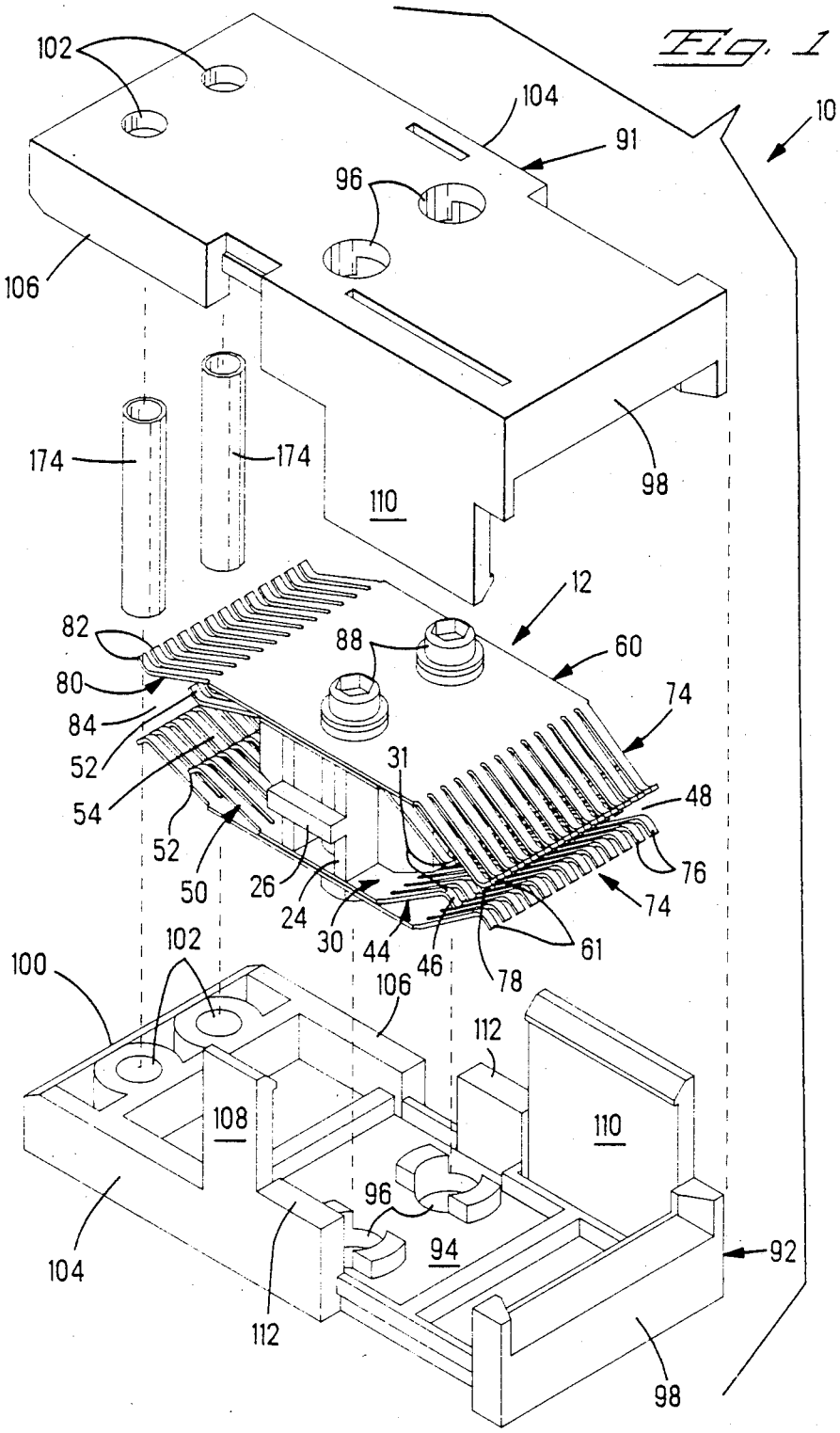
FIG. 1 is a perspective view of the connector assembly with the housing exploded from an assembled electrical connector made in accordance with the invention.
Figure 2:
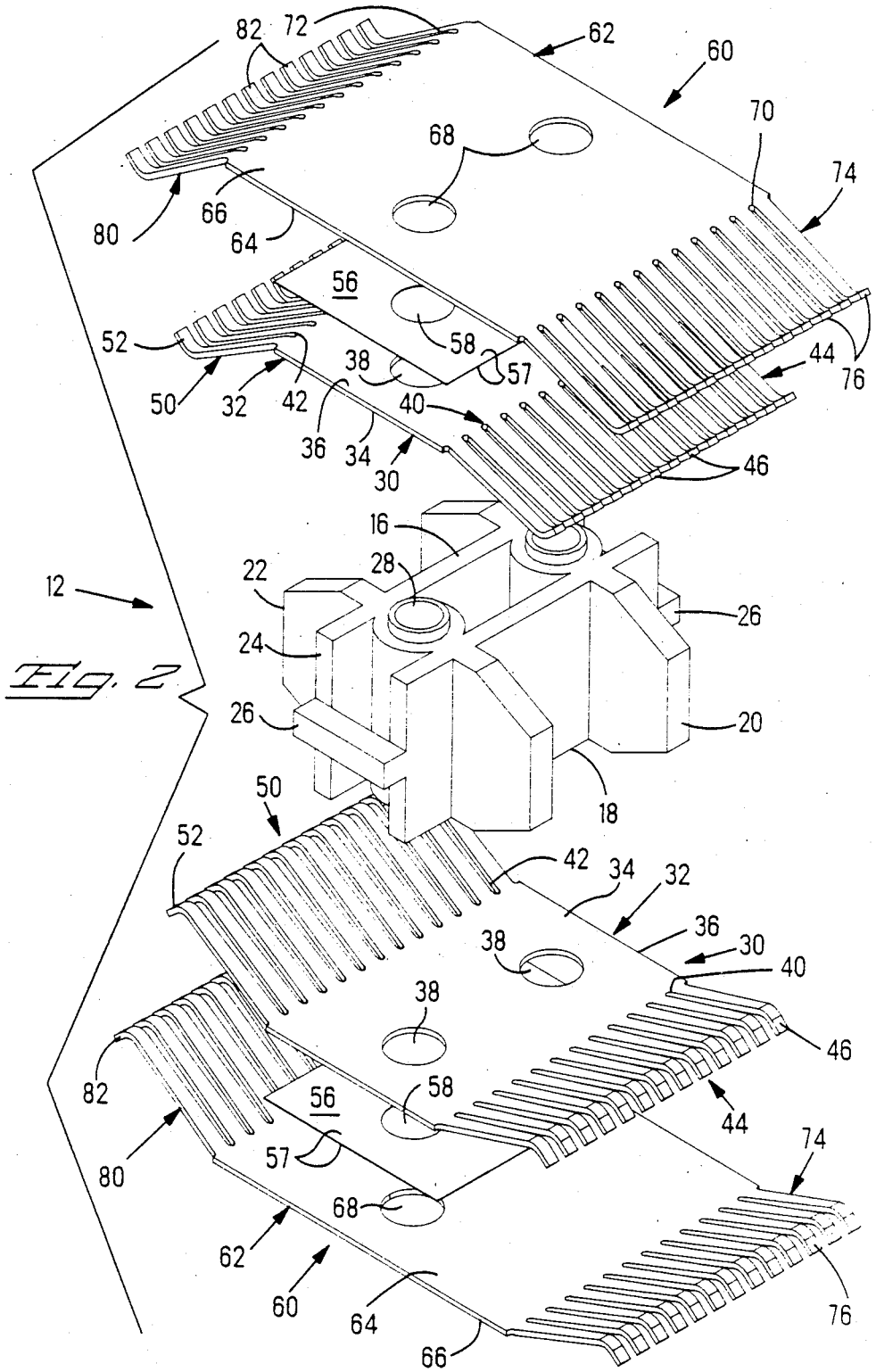
FIG. 2 is an exploded view of the electrical connector of FIG. 1.
Figure 3:
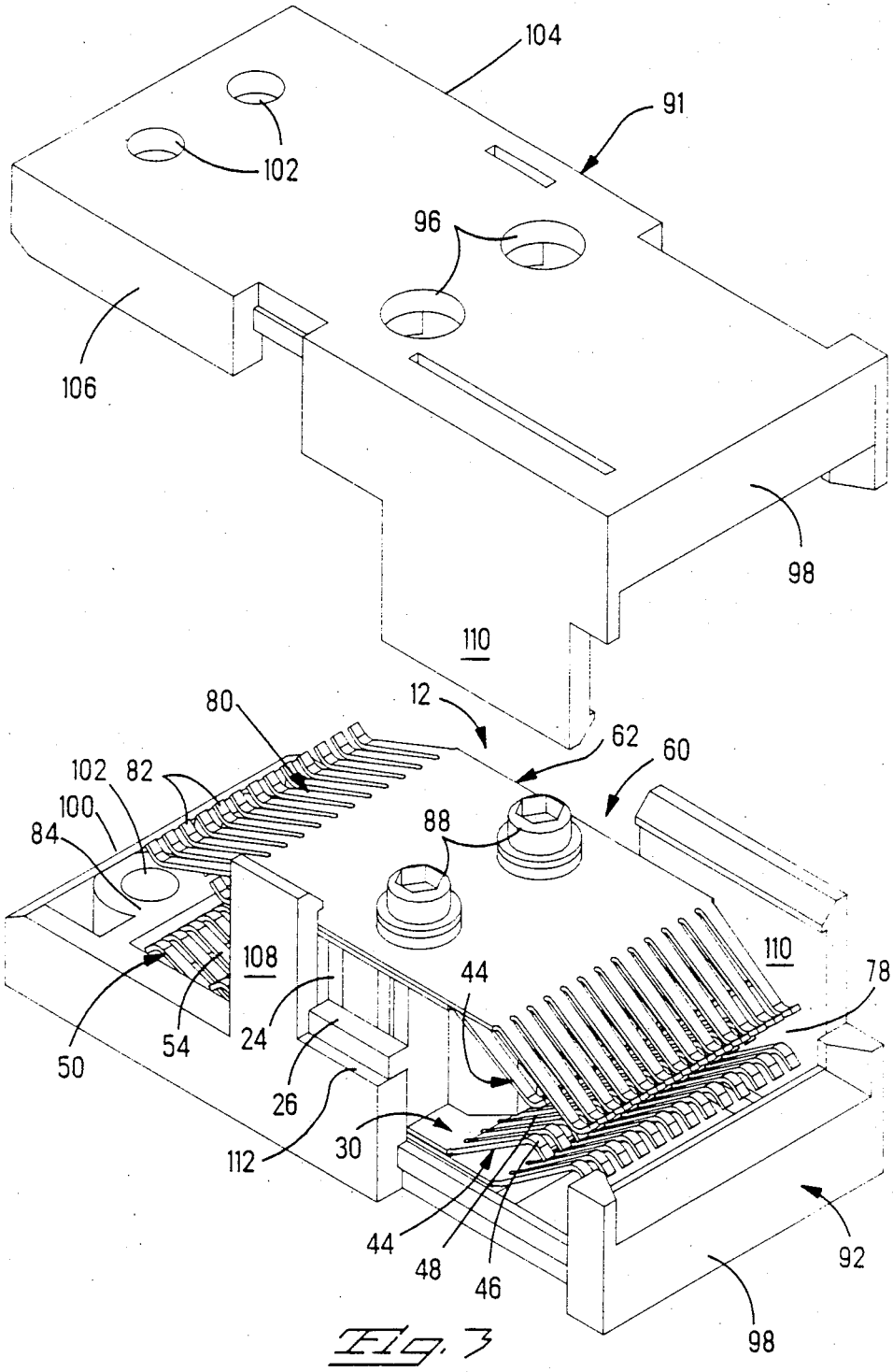
FIG. 3 is an assembled view of connector in one housing portion with the other housing portion exploded therefrom.
Figure 4:
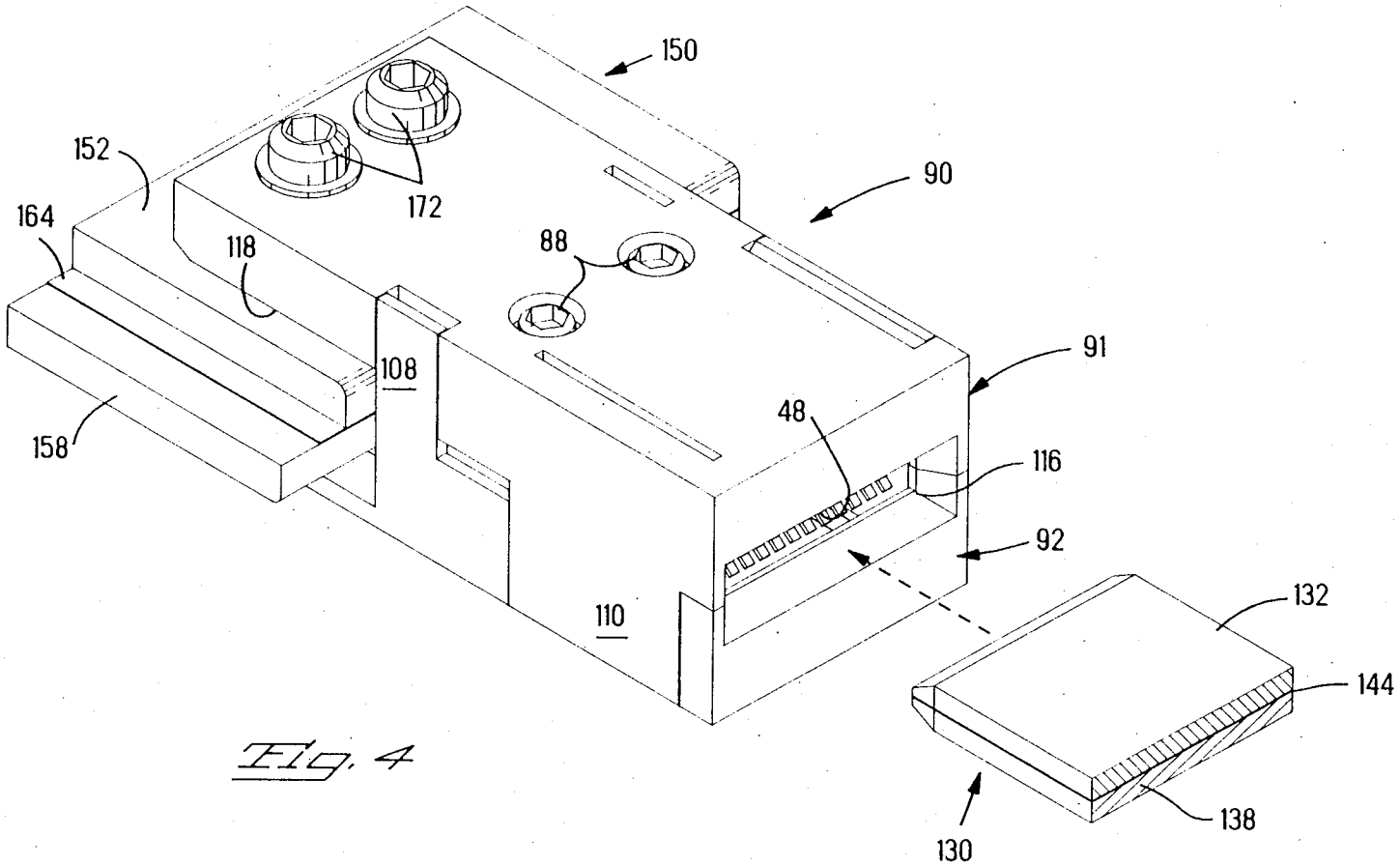
FIG. 4 is a perspective assembled view showing the connector assembly of the present invention mounted to one bar-shaped member and a second member exploded therefrom.
Figure 5:
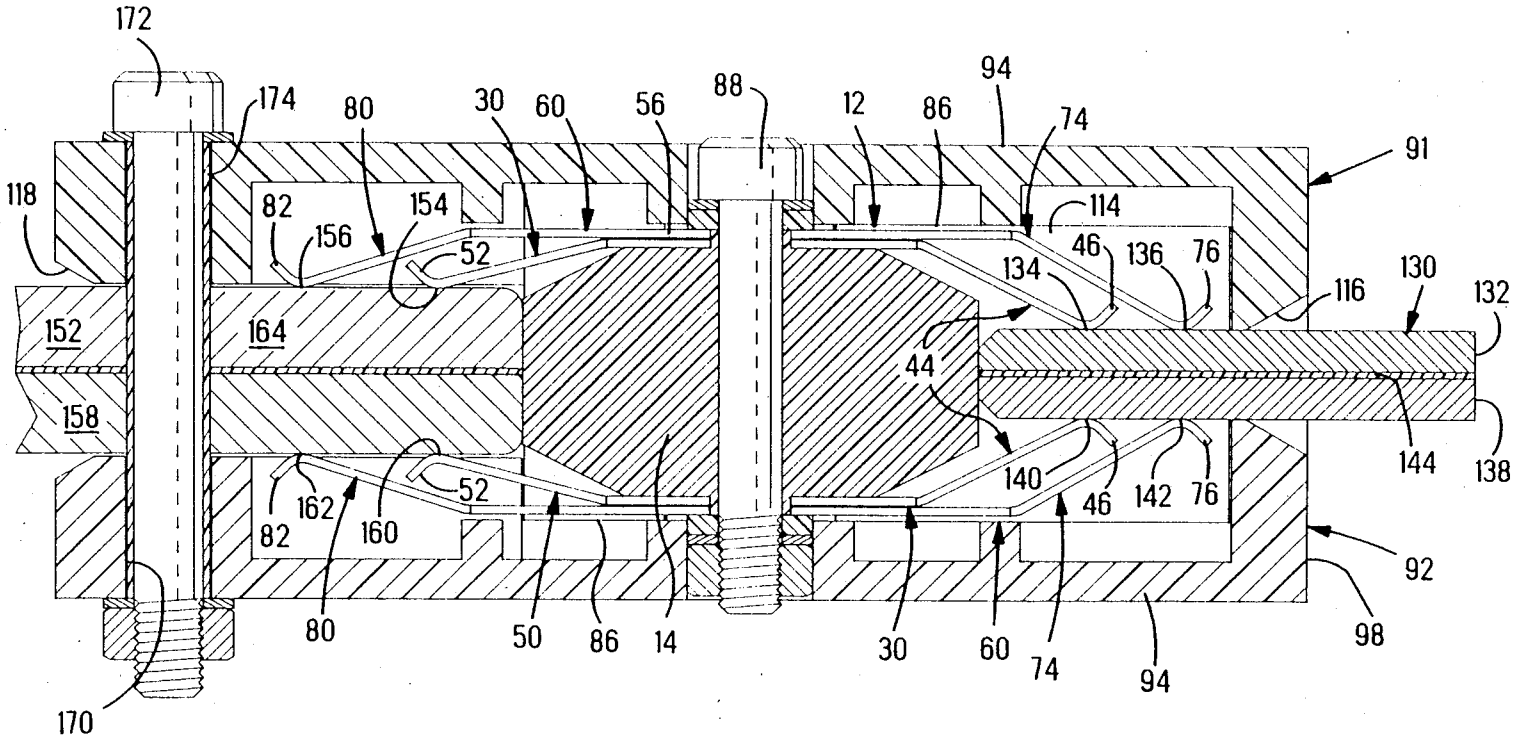
FIG. 5 is a cross sectional view of the connector assembly of the present invention mated with two bar shape members.

Referring now to FIGS. 1, 2 and 4, electrical connector assembly 10 of the present invention is comprised of electrical connector 12 and housing means 90. Connector 12 comprises a dielectric spacer member 14 having opposed major surfaces 16,18, a first terminal element 30 and at least a second terminal element 60 secured to each of the opposing major surfaces 16,18 of the spacer member 14 for electrical interconnection of first and second electrical articles 130, 150 at leading and trailing edges 20,22 respectively thereof, as shown in FIG. 5. Dielectric spacer member 14 further includes opposed sides 24 and apertures 28 extending between opposed major surfaces 16,18. In the preferred embodiment sides 24 further include outwardly extending portions 26 which cooperate with portions of housing means 90 to locate connector 12 therewithin, as shown in FIGS. 3 and 4. In the preferred embodiment dielectric spacer member 14 is molded from a glass filled polyetherimide available from G. E. Plastics, Pittsfield, Mass. under the trade name ULTEM 2300. Other materials known in the art to be stable at high temperatures and non-hydroscopic are also suitable, and for ease of molding preferably has a skeletal-like structure as shown in FIG. 2.

Each first terminal element 30 includes a body section 32 having opposed major inner and outer surfaces 34,36, having aperture 38 extending therethrough and leading and trailing edges 40,42. Body section 32 further includes first and second arrays 44,50 of cantilevered spring contact arms extending outwardly from respective leading and trailing edges 40,42 thereof. In the assembled connector 12, major inner surfaces 34 of a pair 31 of first terminal elements 30 are adjacent opposed major surfaces 16,18 of dielectric spacer 14. The contact arms of arrays 44 and 50 extend to respective free ends 46,52 outwardly from the plane of the respective body section 32 and toward the other first terminal element 30. First and second arrays 44,50 define first and second blade receiving receptacles 48,54 respectively therebetween.

Each second terminal element 60 includes a body section 62 having opposed major inner and outer surfaces 64,66 having aperture 68 extending therethrough and leading and trailing edges 70,72. Body section 62 further includes third and fourth arrays 74,80 of cantilevered spring contact arms extending outwardly from the respective leading and trailing edges 70,72 thereof. In assembling connector 12, the second terminal element 60 is disposed outwardly of the first terminal element 30 and preferably insulated therefrom by insulating means 56 having aperture 58 extending therethrough. The inner major surface 64 of the second terminal element 60 is placed against major surface 57 of insulation means 56 and the pair 61 of second terminal elements form outer receptacle portions 78,84 therebetween.

The contact arms of the third and fourth arrays 74,80 extend to respective free ends 76,82 outwardly from the plane of the respective body section 62 toward the other terminal element 60. The third arrays 74 are proximate and associated with the first arrays 44 and the fourth arrays 80 are proximate and associated with the second arrays 50 as best seen in FIGS. 3 and 5. The spring contact arms of the third and fourth arrays 74,80 are longer than the corresponding spring contact arms of the first and second arrays 44,50. In the assembled connector the free ends 76 of the third array 74 are disposed substantially coplanar with the free ends 46 of the associated first arrays 44 and are located axially outwardly therefrom to extend the first blade receiving receptacle 48. Similarly the free ends 82 of the fourth array 80 are disposed substantially coplanar with the free ends 52 of the second arrays 50 and are located axially outwardly therefrom thereby extending the second blade receiving receptacle 54, as best seen in FIGS. 1 and 5.

Upon mating connector 12 with first and second blade-like members 130,150 and outward deflection against spring bias of all the contact arms by blade members 130,150, the free ends 46,76 of the first and third arrays 44,74 engage the first blade member 130 at a plurality of inner locations 134,140 and outer locations 136,142 along the first and second sides 132,138 respectively thereof. Similarly the free ends 52,82 of the second and fourth arrays 50,80 respectively engage the second blade member 150 at a plurality of inner locations 154,160 and outer locations 156,162 along respective first and second sides 152,158 thereof, as shown in FIG. 5. As also shown in FIG. 5 each set 86 of first and second terminal elements interconnects and provides a plurality of current paths between a corresponding first side 132,152 or corresponding second side 138,158. Since the first terminal element 30 is insulated from the second terminal element 60 in each set 86, the plurality of paths provided by first element 30 are electrically isolated from the parallel paths provided by the second terminal element 60.

In the preferred embodiment connector 12 is assembled by insulated fastening means extending through respective apertures 68,58 and 38 of second terminal element 60, insulating means 56, and first terminal element 30 respectively, through aperture 28 of dielectric spacer member 14 and through respective apertures 38,58,68 of first terminal element 30, insulating means 56, and second terminal element 60 respectively. By using an insulated fastening means, electrical isolation is maintained between the opposed sets 86 of first and second terminal elements respectively. Fastening means 88 secures the connector 12 together and holds terminal elements against dielectric member 14 so that normal force is provided against the blade-like members by the contact arm arrays. Fastening means 88 is shown in FIG. 5 but has been eliminated from FIG. 2 for purposes of clarity.

Connector assembly 10 further includes housing means 90 comprised of first and second dielectric members 91,92, which together define a cavity 114 therebetween in which electrical connector 12 is disposed, as best seen in FIG. 5. Housing means 90 further includes blade-receiving apertures 116 and 118 as shown in FIGS. 4 and 5. The leading and trailing edges for apertures 116,118 of housing means 90 are chamfered to provide lead-ins for blade members 130,150 respectively. Connector 12 is held in cavity 114 of housing means 90 such that the contact arms of respective arrays 44,74; and 50,80 of contact arms extending toward the leading and trailing edges 98,100 respectively thereof. In the preferred embodiment first and second housing members 91,92 are hermaphroditic members. The structure of housing means 90 is best seen by referring to FIG. 1.

Housing portion 92 is comprised of a base 94 having apertures 96 extending therethrough, leading and trailing edges 98,100 and opposed sides 104,106. In the embodiment shown housing member 92 further includes apertures 102 extending therethrough adjacent the trailing edge 100 thereof for receiving mounting means to attach the connector assembly 10 to blade shaped member 150 as shown in FIGS. 4 and 5. Side walls 104 and 106 further include latching means 108,110 respectively and connector locating means 112 which cooperate with extensions 26 on sides 24 of dielectric member spacer member 14 to locate connector 12 within the housing means 90, as best seen in FIGS. 3 and 4. In assembling connector 12 in housing means 90, extensions 26 rest against and between corresponding portions 112 of the hermaphroditic housing members 91,92 with the first extended receptacle 48 adjacent leading end 98 of housing member 92 and second extended receptacle 54 adjacent trailing end 100 thereof. As best seen in FIG. 4 fastening means 88 of connector 12 are located within and extend into apertures 96 of the respective housing members 91,92.

FIGS. 4 and 5 show first and second blade members 130, 150 received in aperture 116, 118 respectively of the connector assembly 10. First blade member 130 is shown as a laminated bar member having first side 132 and second side 138, which are insulated from each other by insulating means 144. The second blade member 150 comprises first side 152 and second side 158, which are insulated from each other by insulating means 164. A dual laminated bus bar member typically is used in power distribution systems to place the hot and return lines in close proximity for a more efficient system. In the embodiment as shown, connector assembly 10 is mounted to blade member 150 by fastening means 172. As shown in FIG. 5, blade-shaped member 150 includes aperture 170 extending therethrough for receiving fastening means 172 therein. To maintain electrical isolation between the two sets 86 of first and second terminal elements 30, 60, an insulating sleeve member 174 is disposed around the fastening means 172. Insulating sleeve members 174 are shown in FIG. 1, the remaining portions of the fastening means however have been eliminated for purposes of clarity.

Terminal elements 30, 60 are preferably stamped and formed members made from a conductive material having the desired mechanical properties, and in particular low stress relaxation. Suitable materials include copper alloys, such as Olin C-151 available from Olin Brass, East Alton, Ill. C-151 has 85% to 95% of the conductivity of pure copper yet retains very good mechanical properties such as tensile strength and low relaxation under stress. The number of contact arms formed on each terminal element depends upon the width of the terminal body and the bar shaped member. The resistance at the interface is lowered and the normal force required per contact arm is lowered by using a plurality of contact arms.

A suitable insulating material for insulation means 56 includes flexible material such as MYLAR available from E. I. DuPont de Nemours and Company and other materials as known in the art.

Depending upon the width of the bus bar or blade-like members to be interconnected and the amount of current to be carried by the members, further terminal elements having other arrays of cantilevered beams formed at leading and trailing edges thereof may be added to the connector in the similar manner as with the second terminal element previously described. The spring contact arms of each succeeding layer will be longer than the previous layers such that a blade receiving receptacle portion is formed outwardly of the previously formed sections. The additional layers will provide additional parallel current paths.

As can be seen from the Figures, the present invention provides an electrical connector having an assembly of terminal elements that can carry high currents of two different voltages across an interface. The present invention further allows the replacement of two single voltage bus bars by a dual voltage laminated bus bar.

Different thicknesses of bus bars can be accommodated by adjusting the beam bending dimensions of the first or second arrays of corresponding terminal elements. It is to be understood that the present invention is not limited to dual bus bar systems only.

It is thought that the electrical connector of the present invention and many of its attendant advantages will be understood from the foregoing description. Changes may be made in the form, construction and arrangement of parts thereof without departing from the spirit and scope of the invention or sacrificing all of its material advantages.

I claim:

1. An electrical connector for mating two blade shaped members, each having opposed first and second sides, said connector comprising:

a dielectric spacer member having opposed major surfaces;

a first terminal element and at least a second terminal element secured to each of said opposing major surfaces of said spacer member for electrical interconnection of first and second electrical articles at leading and trailing edges respectively, said first terminal element being adjacent said spacer member and said second terminal element disposed outwardly of said first terminal element; and means insulating associated said first and second terminal elements from each other;

each said first terminal element including a body section having first and second arrays of cantilevered spring contact arms extending outwardly from respective leading and trailing edges thereof, said contact arms of both said first and second arrays of each said first terminal element extending to respective free ends outwardly from the plane of the respective said body section toward the other first terminal element, said first and second arrays defining first and second blade-receiving receptacles respectively therebetween;

each second terminal element including a body section having third and fourth arrays of cantilevered spring contact arms extending outwardly from respective leading and trailing edges thereof, said contact arms of both said third and fourth arrays of each said second terminal element extending to respective free ends outwardly from the plane of the respective said body section toward the other said second terminal element, said third arrays being proximate and associated with said first arrays, and said fourth arrays being proximate and associated with said second arrays;

said spring contact arms of said third and fourth arrays being longer than the corresponding spring contact arms of said first and second arrays such that the free ends of the contact arms of said third arrays are disposed substantially coplanar with those of the associated first arrays and located axially outwardly therefrom thereby extending said first blade-receiving receptacle, and the free ends of the contact arms of said fourth arrays are disposed substantially coplanar with those of the associated second arrays and located axially outwardly therefrom thereby extending said second blade-receiving receptacle; whereby upon mating said connector with first and second blade-like members and outward deflection against spring bias of all said contact arms by said blade members, said first and third spring contact arm free ends engage said first blade member at a plurality of inner and outer locations along each said first and second sides thereof and said second and fourth spring contact arm free ends engage said second blade member at a plurality of inner and outer locations along each said first and second sides thereof, and each said first pair element interconnects one of said first and second sides of said first blade with a corresponding one of said first and second sides of said second blade along a plurality of current paths forming thereacross, and each said second pair element also interconnects one of said first and second sides of said first blade with a corresponding one of said first and second sides of said second blade along a plurality of current paths therealong, all thereby lowering resistance.

2. The connector of claim 1 including one second terminal element secured to each first terminal element on each opposing surface of spacer member.

3. The connector of claim 1 mounted to a blade-like member and having the respective arrays of contact arms of said first and second terminal elements electrically engaged to said blade-like member.

4. The connector of claim 1 mated with first and second blade-like members, said first and second blade-like members are dual laminated bus bar members and each set of first and second terminal elements thereby provides a plurality of isolated parallel current paths between respective first and second sides thereof.

5. An electrical connector assembly for mating two blade shaped members, each having opposed first and second sides, said connector assembly comprising:

first and second dielectric housing members which together define a connector receiving cavity therebetween; and an electrical connector disposed in said cavity said connector comprising:

a dielectric spacer member having opposed major surfaces;

a first terminal element and at least a second terminal element secured to each of said opposing major surfaces of said spacer member for electrical interconnection of first and second blade-like members at leading and trailing edges respectively, said first terminal element being adjacent said spacer member and said second terminal element disposed outwardly of said first terminal element; and means insulating associated said first and second terminal elements from each other;

each said first terminal element including a body section having first and second arrays of cantilevered spring contact arms extending outwardly from respective leading and trailing edges thereof, said contact arms of both said first and second arrays of each said first terminal element extending to respective free ends outwardly from the plane of the respective said body section toward the other first terminal element, said first and second arrays defining first and second blade-receiving receptacles respectively therebetween;

each second terminal element including a body section having third and fourth arrays of cantilevered spring contact arms extending outwardly from respective leading and trailing edges thereof, said contact arms of both said third and fourth arrays of each said second terminal element extending to respective free ends outwardly from the plane of the respective said body section toward the other said second terminal element, said third arrays being proximate and associated with said first arrays, and said fourth arrays being proximate and associated with said second arrays;

said spring contact arms of said third and fourth arrays being longer than the corresponding spring contact arms of said first and second arrays such that the free ends of the contact arms of said third arrays are disposed substantially coplanar with those of the associated first arrays and located axially outwardly therefrom thereby extending said first blade-receiving receptacle, and the free ends of the contact arms of said fourth arrays are disposed substantially coplanar with those of the associated second arrays and located axially outwardly therefrom thereby extending said second blade-receiving receptacle; whereby upon mating said connector with first and second blade-like members and outward deflection against spring bias of all said contact arms by said blade members, said first and third spring contact arm free ends engage said first blade member at a plurality of inner and outer locations along each said first and second sides thereof and said second and fourth spring contact arm free ends engage said second blade member at a plurality of inner and outer locations along each said first and second sides thereof, and each said first pair element interconnects one of said first and second sides of said first blade with a corresponding one of said first and second sides of said second blade along a plurality of current paths forming thereacross, and each said second pair element also interconnects one of said first and second sides of said first blade with a corresponding one of said first and second sides of said second blade along a plurality of current paths therealong, all thereby lowering resistance.

6. The connector assembly of claim 5 wherein said housing members are hermaphroditic members.

7. The connector assembly of claim 5 wherein said housing means includes means for mounting said assembly to one of said blade-like member.

* * * * *